US005802881A

United States Patent [19]

Lin

[11] Patent Number: 5,802,881

[45] Date of Patent: Sep. 8, 1998

[54] KNITTING MACHINE THREAD WHEEL CONSTRUCTION

[76] Inventor: Tean-Lai Lin, No. 272, Chun Shing Street, Shu Lin Chen, Taipei Hsien, Taiwan

[21] Appl. No.: 792,752

[22] Filed: Feb. 4, 1997

[51] Int. Cl.[6] ..... D04B 15/48

[52] U.S. Cl. ..... 66/132 T; 242/17.01; 226/168

[58] Field of Search ..... 139/132 T, 132 R; 242/47.01; 226/168

[56] References Cited

U.S. PATENT DOCUMENTS

| | | | |
|---|---|---|---|
| 3,709,444 | 1/1973 | Tannert | 242/47.01 |
| 3,955,769 | 5/1976 | Kajiura et al. | 242/47.01 |
| 4,003,223 | 1/1977 | Tholander | 242/47.01 |
| 4,645,134 | 2/1987 | Sarfati | 242/47.01 |
| 4,793,565 | 12/1988 | Fecker | 242/47.01 |
| 4,918,948 | 4/1990 | Nurk | 66/132 T |

*Primary Examiner*—Andy Falik
*Attorney, Agent, or Firm*—Varndell Legal Group

[57] ABSTRACT

A thread wheel including a top wheel base and bottom wheel base connected together and fastened to a center shaft of an automatic thread storage and feeding unit of a knitting machine. The top and bottom wheels have a respective set of equiangularly spaced radial locating holes. A plurality of supporting elements are connected between the locating holes of the top wheel base and the locating holes of the bottom wheel base for guiding thread in and out and for storing thread. The supporting elements are respectively made from an elongated flat plate, each supporting element having two rectangular ends respectively fitted into the locating holes of the top wheel base and the locating holes of the bottom wheel base.

1 Claim, 6 Drawing Sheets

KNITTING MACHINE THREAD WHEEL CONSTRUCTION

BACKGROUND AND SUMMARY OF THE INVENTION

The present invention relates to a thread wheel for the automatic thread storage and feeding unit of a knitting machine, and relates more particularly to such a thread wheel in which the supporting elements can be conveniently and firmly installed to provide the thread wheel with a better roundness.

FIG. 1 shows a thread wheel installed in the automatic thread storage and feeding unit of a knitting machine according to the prior art. This thread wheel is comprised of a top wheel base, a bottom wheel base fastened to the top wheel base and the shaft of the automatic thread storage and feeding unit by a screw bolt, a metal bottom cover fastened to the bottom wheel base at the bottom by screws, a plurality of supporting wires having a respective rounded top end fastened to a respective circular locating hole (not shown) in the top wheel base and a respective rounded bottom end fastened to a respective circular locating hole (not shown) in the bottom wheel base. The bottom wheel base has a cylindrical metal hub shell with holes for thread output. This thread wheel is complicated to manufacture because it is comprised of a large number of parts. The top wheel base and the bottom wheel base may be respectively injection-molded from plastic, however the complicated stamping manufacturing process of the metal wheel hub shell and the metal bottom cover greatly increases the manufacturing cost and the assembly time. Because the two opposite ends of the supporting wires have a respective rounded shape, and the respective locating holes of the top wheel base and bottom wheel base have a respective rounded shape adapted for receiving the supporting wires, when the supporting wires are installed, they must be calibrated so as to provide the thread wheel with a better true roundness. However, because the supporting wires are made from metal wires by a spring making machine, they may slightly vary with one another in size. Therefore, it is difficult to obtain a true roundness when the supporting wires are installed.

The present invention has been accomplished to provide a thread wheel which eliminates the aforesaid drawbacks. According to one aspect of the present invention, the supporting elements, which are connected between the top wheel base and the bottom wheel base for guiding thread in and out and for storing thread, are made from a metal sheet by stamping. The manufacturing process is efficient, and less expensive. According to another aspect of the present invention, each supporting element has a rectangular bottom end fitted into a respective rectangular locating hole in the bottom wheel base. Because the bottom end of each supporting element has a rectangular cross section fitted into a respective rectangular locating hole in the bottom wheel base, the installation of the supporting elements can be easily and positively achieved. When installed, the supporting elements do not displace, and will not be turned relative to the top wheel base and the bottom wheel base, therefore the supporting elements can provide the thread wheel with a better true roundness.

DETAILED DESCRIPTION OF THE PREFERRED EMBODIMENT

Figure 1:
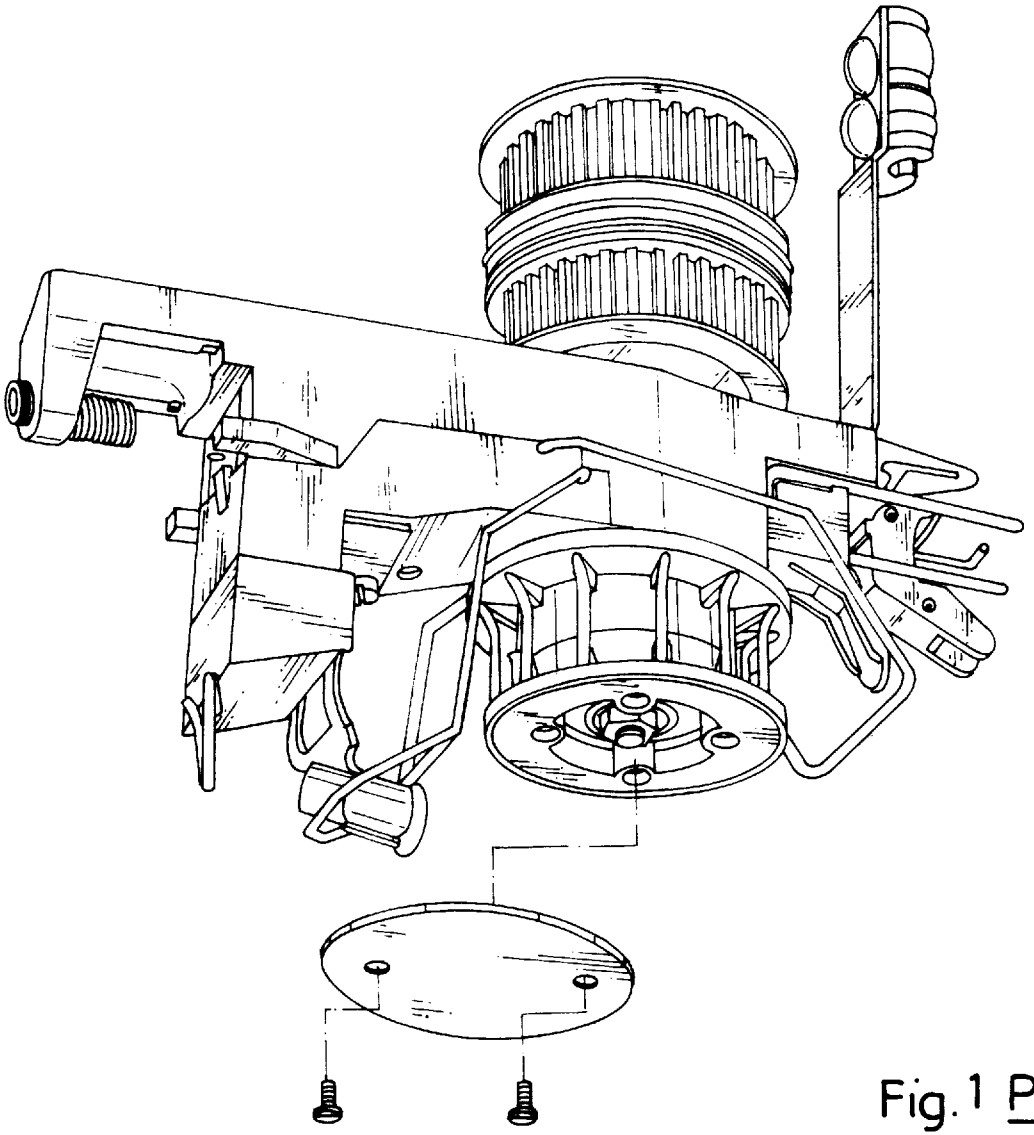
Fig. 1 PRIOR ART
FIG. 1 shows a thread wheel installed in the automatic thread storage and feeding unit of a knitting machine according to the prior art.
Figure 2:
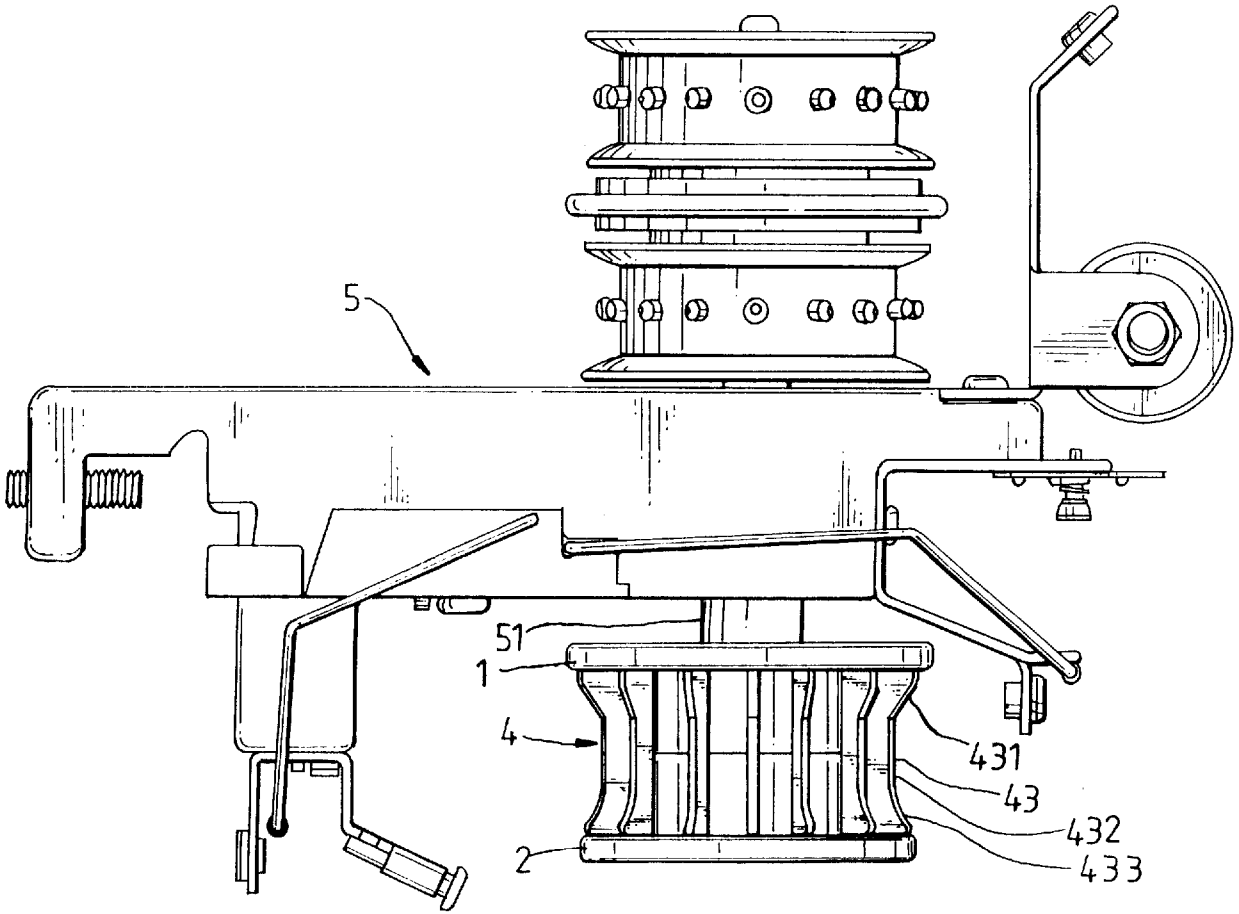
FIG. 2 shows a thread wheel installed in the automatic thread storage and feeding unit of a knitting machine according to the present invention.
Figure 3:
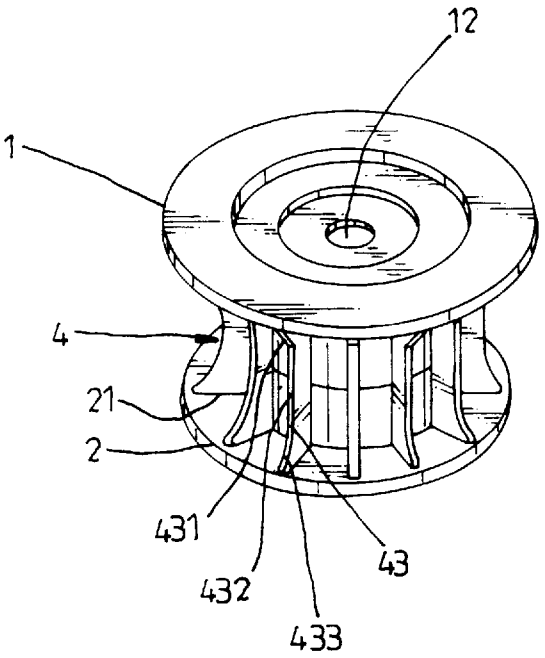
FIG. 3 is an elevational view of the thread wheel shown in FIG. 2.
Figure 4:
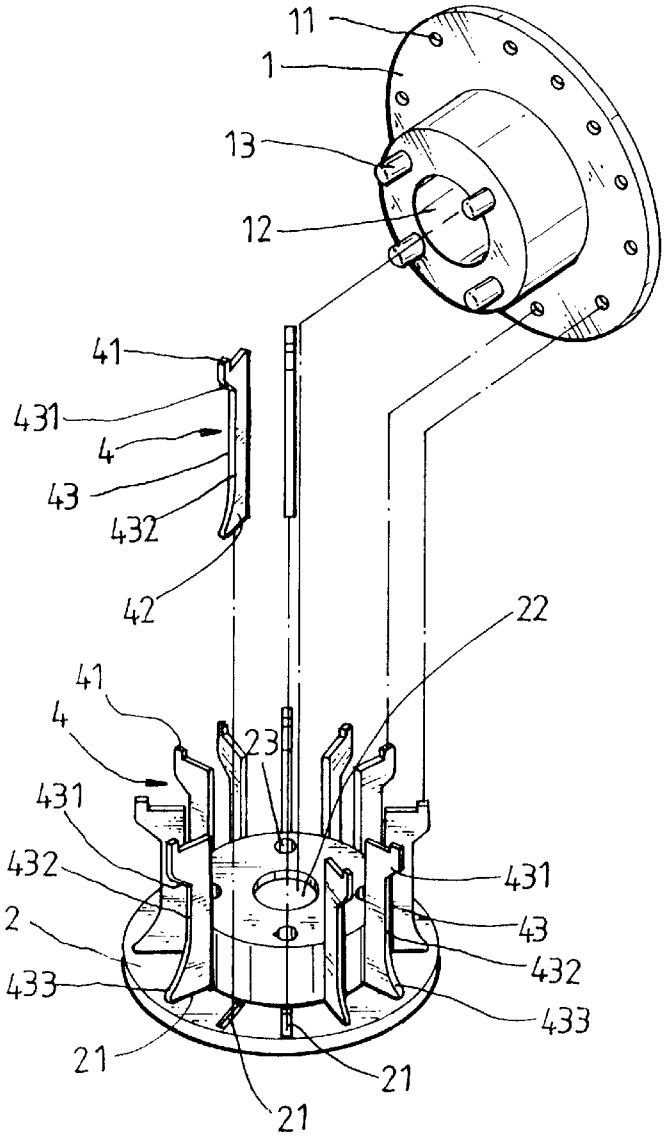
FIG. 4 is a side view in section of FIG. 3.
Figure 5:
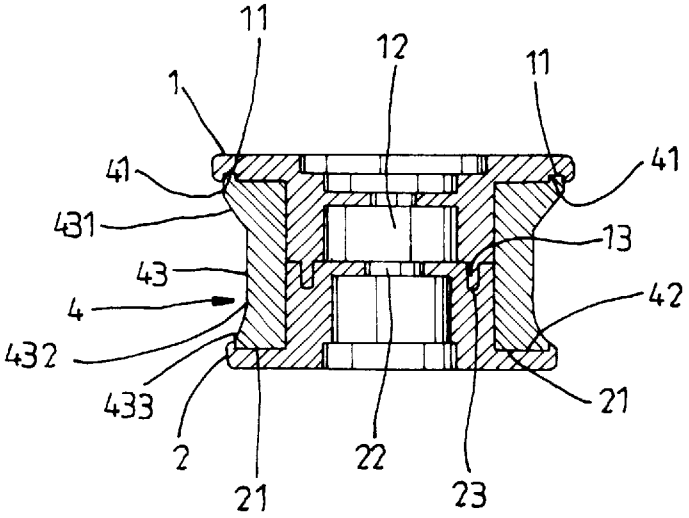
FIG. 5 is an exploded view of the thread wheel shown in FIG. 3.

Referring to FIGS. from 2 to 5, a thread wheel in accordance with the present invention is generally comprised of a top wheel base 1, a bottom wheel base 2, and a plurality of supporting elements 4. The top wheel base 1 has a plurality of locating holes 11 equiangularly spaced around the periphery, a center through hole 12, and a plurality of mounting plug rods 13 spaced around the center through hole 12. The bottom wheel base 2 has a plurality of locating holes 21 equiangularly spaced around the periphery corresponding to the locating holes 11 of the top wheel base 1, a center through hole 22 adapted for connecting with the center through hole 12 of the top wheel base 1 to the center shaft 51 of an automatic thread storage and feeding unit 5 by a screw bolt, and a plurality of plug holes 23 spaced around the center through hole 22 and adapted for receiving the mounting plug rods 13 of the top wheel base 1. By fitting the mounting plug rods 13 of the top wheel base 1 into the plug holes 23 of the bottom wheel base 2, the top wheel base 1 and the bottom wheel base 2 are connected together. Before fastening the top wheel base 1 and the bottom wheel base 2 together, the supporting elements 4 are connected between the top wheel base 1 and the bottom wheel base 2. Each of the supporting elements 4 comprises a top end 41 fitted into one locating hole 11 of the top wheel base 1, a bottom end 42 fitted into one locating hole 21 of the bottom wheel base 1, and a longitudinal, recessed, outer face 43 disposed between the top end 41 and the bottom end 42. The outer face 43 is comprised of an upper section 431 adapted for guiding thread in, a lower section 433 adapted for guiding thread out, and a middle section 432 connected between the upper section 431 and the lower section 433 and adapted for storing thread.

The locating holes 21 of the bottom wheel base 2 are equiangularly and radially spaced around the center through hole 22, having a respective rectangular cross section with the two long sides arranged in the radial direction. Each of the supporting elements 4 is respectively made from an elongated flat plate. The bottom end 42 of each of the supporting elements 4 has a rectangular cross section fitting the locating holes 21 of the bottom wheel base 2. Therefore, when the supporting elements 4 are installed in the locating holes 11 of the top wheel base 1 and the locating holes 21 of the bottom wheel base 1, they are firmly retained in place and prohibited from being turned in the locating holes 11, 21. Because the supporting elements 4 do not displace when installed, it is not necessary to verify the true roundness of the thread wheel.

Figure 6:
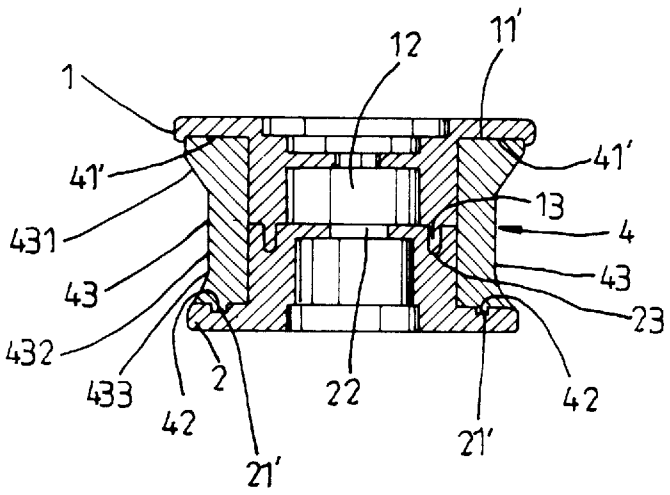
FIG. 6 is a sectional side view of an alternate form of the thread wheel according to the present invention.

FIG. 6 shows an alternate form of the present invention, in which the locating holes 11' of the top wheel base 1 are equiangularly and radially spaced around the center through hole 12, having a respective rectangular cross section with the two long sides arranged in the radial direction. Each of the supporting elements 4 is respectively made from an elongated flat plate. The top end 41' of each of the supporting elements 4 has a rectangular cross section fitting the locating holes 11' of the top wheel base 1. When the supporting elements 4 are installed in the locating holes 11' of the top wheel base 1 and the locating holes 21' of the bottom wheel base 1, they are firmly retained in place and prohibited from being turned in the locating holes 11', 21'.

We claim:

1. A thread wheel of the type comprising: a top wheel base having a plurality of locating holes equiangularly spaced around the periphery, a center through hole, and a plurality of mounting plug rods spaced around the center through hole; a bottom wheel base having a plurality of locating holes equiangularly spaced around the periphery corresponding to the locating holes of said top wheel base, a center through hole longitudinally connected to the center hole of said top wheel base and adapted to be connected to a center shaft of an automatic thread storage and feeding unit of a knitting machine by a screw bolt, and a plurality of plug holes spaced around the center through hole of said bottom wheel base which receive the mounting plug rods of said top wheel base; and supporting elements connecting said top wheel base to said bottom wheel base, said supporting elements having two opposite ends respectively fitted into the locating holes of said top wheel base and the locating holes of said bottom wheel base, and an outer face disposed between two opposite ends, said outer face comprised of an upper section adapted for guiding thread in, a lower section adapted for guiding thread out, and a middle section adapted for storing thread, wherein said supporting elements comprise an elongated flat plate, at least one end of each of said supporting element having a rectangular cross section, the locating holes of said top wheel base and said bottom wheel base being adapted for receiving the two opposite ends of said supporting elements, and having a respective cross section fitting the cross section of the respective end of the respective supporting element.

* * * * *